US009297612B2

(12) United States Patent
Schmadeka

(10) Patent No.: US 9,297,612 B2
(45) Date of Patent: Mar. 29, 2016

(54) WALLET STYLE HANDGUN HOLSTER

(71) Applicant: Kevin Lee Schmadeka, Puyallup, WA (US)

(72) Inventor: Kevin Lee Schmadeka, Puyallup, WA (US)

( * ) Notice: Subject to any disclaimer, the term of this patent is extended or adjusted under 35 U.S.C. 154(b) by 0 days.

(21) Appl. No.: 14/625,392

(22) Filed: Feb. 18, 2015

(65) Prior Publication Data

US 2015/0233671 A1 Aug. 20, 2015

Related U.S. Application Data

(60) Provisional application No. 61/966,249, filed on Feb. 20, 2014.

(51) Int. Cl.
*F41C 33/02* (2006.01)
*F41C 33/04* (2006.01)

(52) U.S. Cl.
CPC ..... *F41C 33/0209* (2013.01); *F41C 33/048* (2013.01)

(58) Field of Classification Search
CPC ..... F41C 33/0218; F41C 33/0245; F41C 33/048; F41C 33/0209; F41C 33/006; F41C 33/041; F41C 9/02; F41C 33/0236; F41C 33/0263; F41A 17/54; Y10S 224/911
USPC ..... 224/587, 244, 243, 242, 236, 238, 192, 224/911, 230; 40/70.07, 70.06, 70.11; 206/317
See application file for complete search history.

(56) References Cited

U.S. PATENT DOCUMENTS

| | | | | |
|---|---|---|---|---|
| 4,466,537 | A * | 8/1984 | McMahan | 206/317 |
| 5,234,145 | A * | 8/1993 | Padin | 224/243 |
| D385,108 | S * | 10/1997 | Tschudy | D3/262 |
| 5,810,222 | A * | 9/1998 | Shoemaker | 224/244 |
| 8,302,827 | B1 * | 11/2012 | Cole | 224/243 |

* cited by examiner

*Primary Examiner* — Adam Waggenspack
*Assistant Examiner* — Matthew Theis
(74) *Attorney, Agent, or Firm* — George A. Leone; Citadel Patent Law

(57) ABSTRACT

A wallet style holster for holding and concealing a handgun includes an elongated panel including a top flap portion and a bottom flap portion having a handgun retaining element attached to the bottom flap portion where the handgun retaining element includes a trigger guard retention portion and a forward block. At least one protrusion is separated from the forward block by a channel, where the channel and the protrusion are formed to receive a handgun trigger and trigger guard which is held between the protrusion and the forward block. The top flap portion of the elongated panel may be folded over the bottom flap portion to form a wallet, sized so as to be adapted to cover a handgun and fit in a pocket.

14 Claims, 8 Drawing Sheets

WALLET STYLE HANDGUN HOLSTER

CROSS-REFERENCE TO RELATED APPLICATIONS

This application is a non-provisional application of and claims priority from U.S. Provisional Patent Application No. 61/966,249, filed Feb. 20, 2014 to Schmadeka and entitled "Wallet Style Handgun Holster," the entire contents of which is incorporated by reference.

TECHNICAL FIELD

The present invention is in the field of hand gun holsters, and, more particularly, to a wallet style handgun holster.

BACKGROUND

The vast majority of wallet-style handgun holsters come with certain drawbacks. Principal among them is that the butt end of the gun, which faces upward, is not completely covered by the holster. This carries a risk to the user that a person in close proximity might see down into the pocket and spot the weapon. In some places and situations this can lead to adverse reactions and negative consequences, even if the weapon is legally carried and not prohibited by policy of the property owner. It is therefore desirable to have the weapon fully concealed from view in such situations. It is also desirable to be able to deploy the weapon faster than what is permitted by current wallet-style holsters that fully conceal the weapon.

Some existing wallet holsters consist of a single unfolded rectangular piece of stiff leather, with the holster affixed to one side, and are designed to have the pistol drawn from the holster while inside the pocket. While this method works well for some users, many have difficulty mastering the techniques for drawing. Also, many of these holsters tend to cling to the gun and be drawn from the pocket along with it, interfering with deployment of the weapon. These holsters are also typically the ones that have no covering over the butt to conceal it completely while in the pocket. Some of these types of holsters do have an additional small leather flap on the top end that is made to hide the weapon completely, but this flap can interfere further with the drawing of the weapon.

Other types of wallet holsters are made to hold the gun and holster together as one unit, and permit firing of the gun while still inside the holster. While being a viable option for many people, these holsters also do not fully conceal the butt or slide of the weapon, as that would interfere with operation of the slide. Some of these types of holsters are made to cover the entire weapon however, while permitting the handgun to be fired while inside of it, and these holsters can run afoul of Federal NFA regulations relating to "any other weapon," which cover firearms that are disguised to look like objects other than firearms.

Other wallet holsters are made with a folded leather covering that completely covers the outside and the butt of the weapon, but these typically utilize a conventional holster within the covering, which the pistol must be drawn from, substantially slowing deployment.

The inventor knows of no wallet-style holster that fully conceals the back end of the pistol from view while in the pocket, utilizes dimensions as small as the outside dimensions of the pistol, and permits the pistol to be quickly and easily flipped or dropped out of the wallet holster upon removal from the pocket and opening, without need to draw the pistol from another containment device inside the wallet covering.

BRIEF SUMMARY OF THE DISCLOSURE

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

A wallet style holster for holding and concealing a handgun is disclosed comprising an elongated panel including a top flap portion and a bottom flap portion having a handgun retaining element attached to the bottom flap portion where the handgun retaining element includes a trigger guard retention portion and a forward block. At least one protrusion is separated from the forward block by a channel, where the channel and the protrusion are formed to receive a handgun trigger and trigger guard which is held between the protrusion and the forward block. The top flap portion of the elongated panel may be folded over the bottom flap portion to form a wallet, sized so as to be adapted to cover a handgun and fit in a pocket.

In one aspect the handgun retaining element conforms to removably mate with a selected handgun style.

In another aspect the retaining element includes a magazine storage port built into the forward block.

In another aspect the retaining element is affixed to one end of the elongated panel with materials selected from the group consisting of rivets, bolts metal screws, plastic screws, glue, epoxy, and combinations thereof.

In another aspect the elongated panel comprises a single piece of leather having a thickness suitable for folding over a conventionally sized handgun while still fitting in the back pocket of a pair of pants, jeans so as to conceal any enclosed handgun.

In another aspect the elongated panel has a length in the range of 10-13 inches and a width in the range of 3-5 inches.

In another aspect the retaining element comprises a molded insert constructed from materials selected from the group consisting of nylon, plastic, polymer compositions, metal, rubber and combinations thereof.

In another aspect, a wallet style holster for holding a handgun includes a pair of mating retaining blocks, a first block attached to the top flap portion and a second block attached to the bottom flap portion where each of the pair of mating retaining blocks has matching channels to accommodate a trigger guard, and if needed for the particular pistol, matching channels to accommodate a trigger, and each of the mating blocks includes a cavity configured to accept and hold a handgun portion.

BRIEF DESCRIPTION OF THE DRAWINGS

While the novel features of the invention are set forth with particularity in the appended claims, the invention, both as to organization and content, will be better understood and appreciated, along with other objects and features thereof, from the following detailed description taken in conjunction with the drawings, in which:

Figure 1:
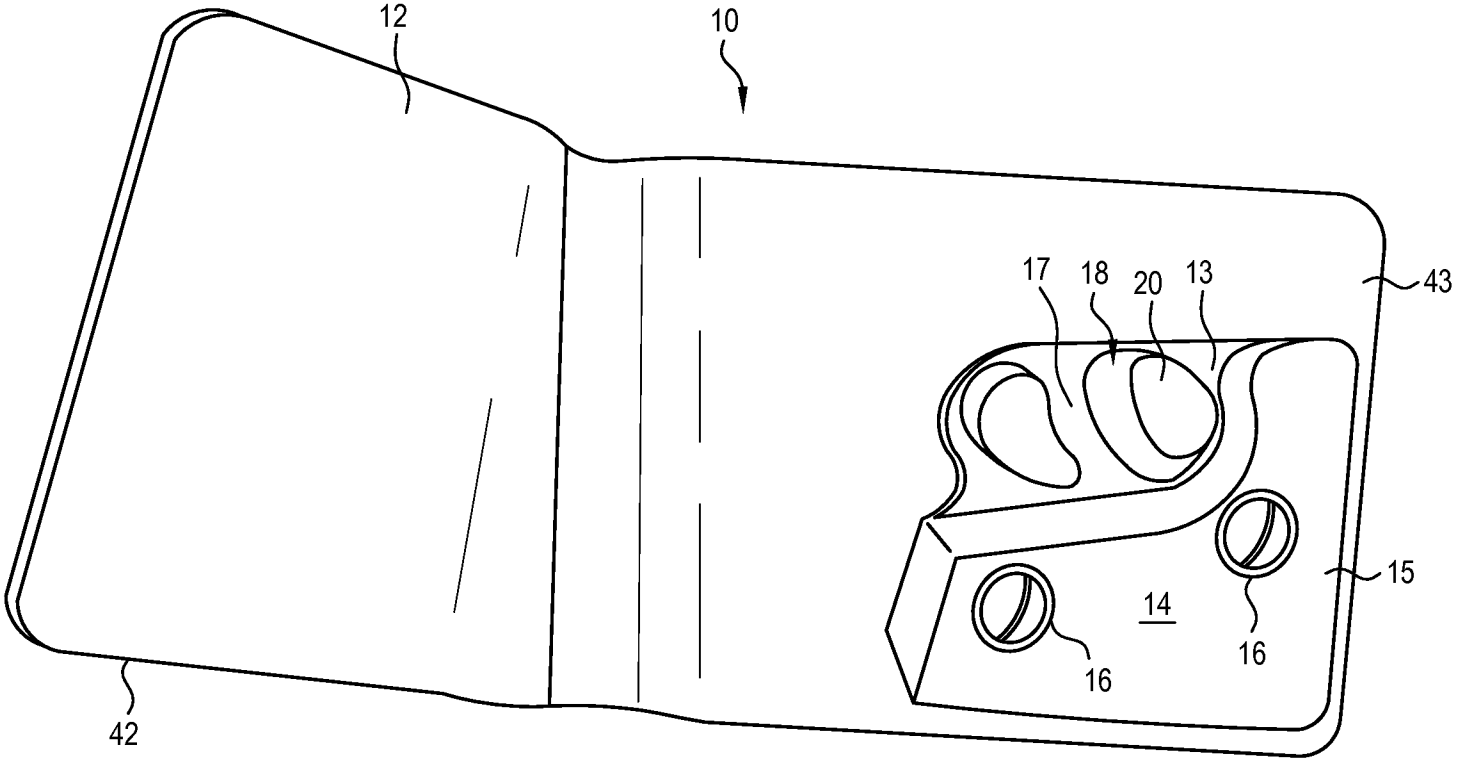
FIG. 1 schematically shows an inside view of an example embodiment of a wallet style holster assembled in accordance with the present disclosure.

In the drawings, identical reference numbers identify similar elements or components. The sizes and relative positions of elements in the drawings are not necessarily drawn to scale. For example, the shapes of various elements and angles are not drawn to scale, and some of these elements are arbitrarily enlarged and positioned to improve drawing legibility. Further, the particular shapes of the elements as drawn, are not intended to convey any information regarding the actual shape of the particular elements, and have been solely selected for ease of recognition in the drawings.

DETAILED DESCRIPTION OF THE PREFERRED EMBODIMENTS

The following disclosure describes several embodiments for a wallet style handgun holster. Several features of methods and systems in accordance with example embodiments are set forth and described in the Figures. It will be appreciated that methods and systems in accordance with other example embodiments can include additional procedures or features different than those shown in the Figures. Example embodiments are described herein with respect to a folding leather wallet. However, it will be understood that these examples are for the purpose of illustrating the principles, and that the invention is not so limited. Additionally, methods and systems in accordance with several example embodiments may not include all of the features shown in the Figures.

Unless the context requires otherwise, throughout the specification and claims which follow, the word "comprise" and variations thereof, such as, "comprises" and "comprising" are to be construed in an open, inclusive sense that is as "including, but not limited to."

Reference throughout this specification to "one example" or "an example embodiment," "one embodiment," "an embodiment" or combinations and/or variations of these terms means that a particular feature, structure or characteristic described in connection with the embodiment is included in at least one embodiment of the present disclosure. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

Referring now to FIG. 1, an inside view of an example embodiment of a wallet style holster assembled in accordance with the present disclosure is schematically shown. A wallet style holster 10 includes an elongated panel 12. The elongated panel 12 includes a top flap portion 42 and a bottom flap portion 43. A handgun retaining element 14 is attached to the bottom flap portion 43. The handgun retaining element 14 may advantageously be constructed similar to a mold with cavities conforming to receive the shape of a selected handgun portion to be inserted and held therein. The handgun retaining element 14 advantageously includes, for example, a trigger guard retention region 18. The trigger guard retention region 18 includes at least one protrusion 20 separated from a forward block 15 of the retaining element 14 by a channel 13. The trigger guard retention portion may feature a channel 17 through the center to accommodate the trigger, if the pistol trigger design warrants it. When the central channel 17 is used, it splits the at least one protrusion 20 into a pair of protrusions which together are encompassed by the trigger guard of an inserted handgun (not shown).

In order to secure the pistol in place inside the leather covering, the handgun retaining element 14 may comprise a plastic insert that is molded to fill the empty space below a handgun barrel and forward of the grip while holding the inside of the trigger guard. In order to give the entire holster a uniform thickness, the plastic insert may advantageously be made to be approximately the same thickness as the pistol.

In one example the elongated panel 12 may advantageously be constructed from a single piece of leather having a thickness suitable for folding over a conventionally sized handgun while still fitting in the back pocket of a pair of pants, jeans or the like. For example, the panel may be in the range of about 10-13 inches long with a width in the range of about 3-5 inches and a thickness in the range of about 0.13-0.3 inches.

The handgun retaining element 14 may advantageously be, for example, a molded insert conventionally molded or machined from materials such as nylon, plastic, polymer compositions, metal, rubber or equivalents. In one embodiment fastening devices 16 may comprise rivets, bolts metal screws and the like. However, those skilled in the art will understand that the invention is not so limited and that any suitable attachment mechanism can be employed. These include, for example, plastic screws, glue, epoxy, combinations of these and the like. The wallet may also be constructed as a unitary, integrated molded or machined piece. In order to permit rapid deployment of the pistol from the holster, the molded insert is made sufficiently larger than the selected handgun to allow the handgun or pistol to be flipped or dropped from the holster into the hand upon opening.

Figure 2:
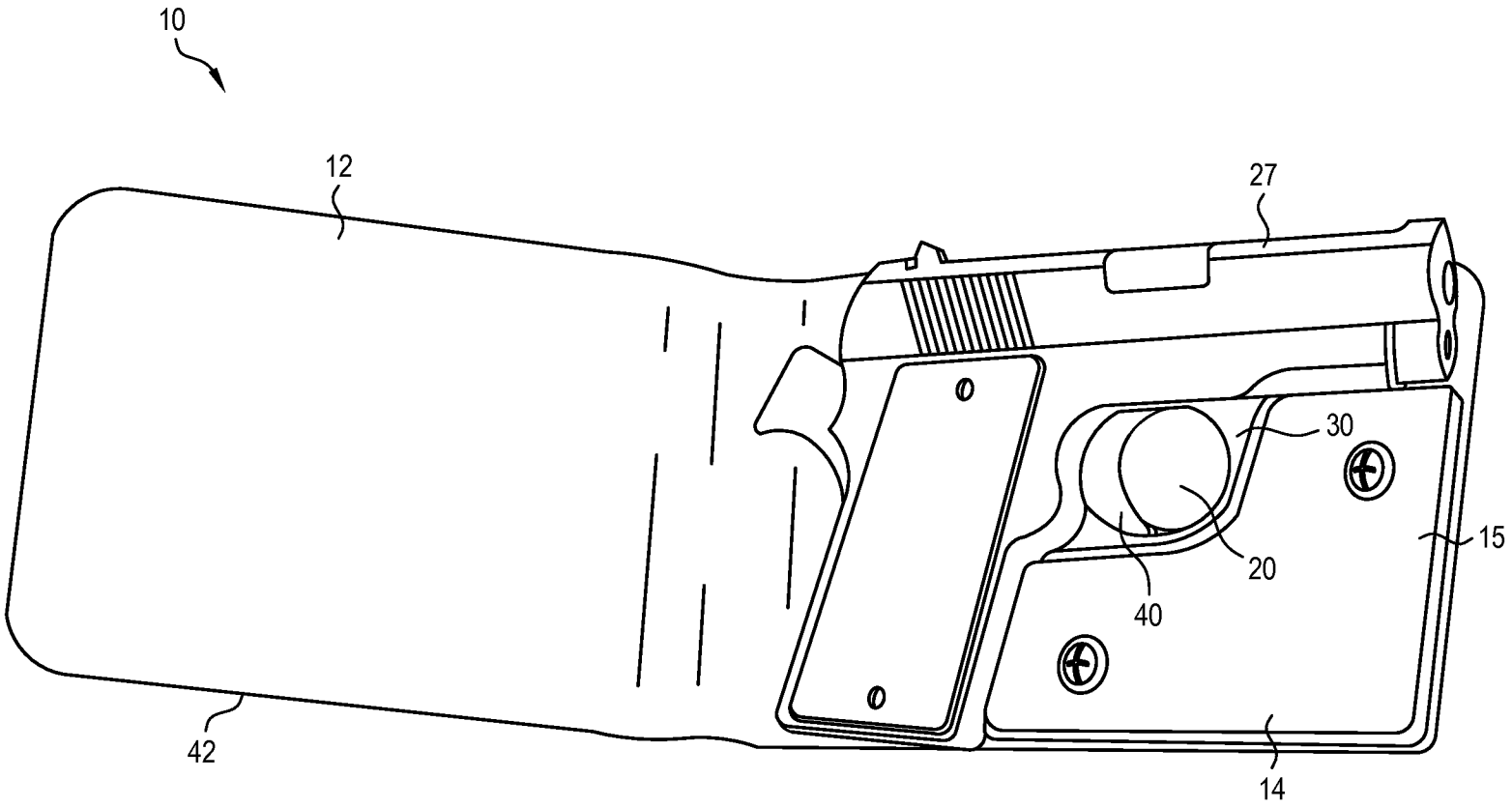
FIG. 2 schematically shows an inside view of an example embodiment of a wallet style holster with a handgun mounted in the holster retaining element assembled in accordance with the present disclosure.

Referring now to FIG. 2, an inside view of an example embodiment of a wallet style holster with a handgun mounted in the holster retaining element assembled in accordance with the present disclosure is schematically shown. A handgun 27 is shown held in position where a trigger guard 30 is inserted into the channel 13 and the trigger guard 30 and a trigger 40 are held in place between the protrusion 20 and the forward block 15. After the handgun is inserted, the top flap portion 42 of the wallet may be folded over the handgun and the wallet placed in a pocket until ready for withdrawal. The folded outer flap serves as a retaining element that holds a pistol secured inside while the flap is closed.

Figure 3:
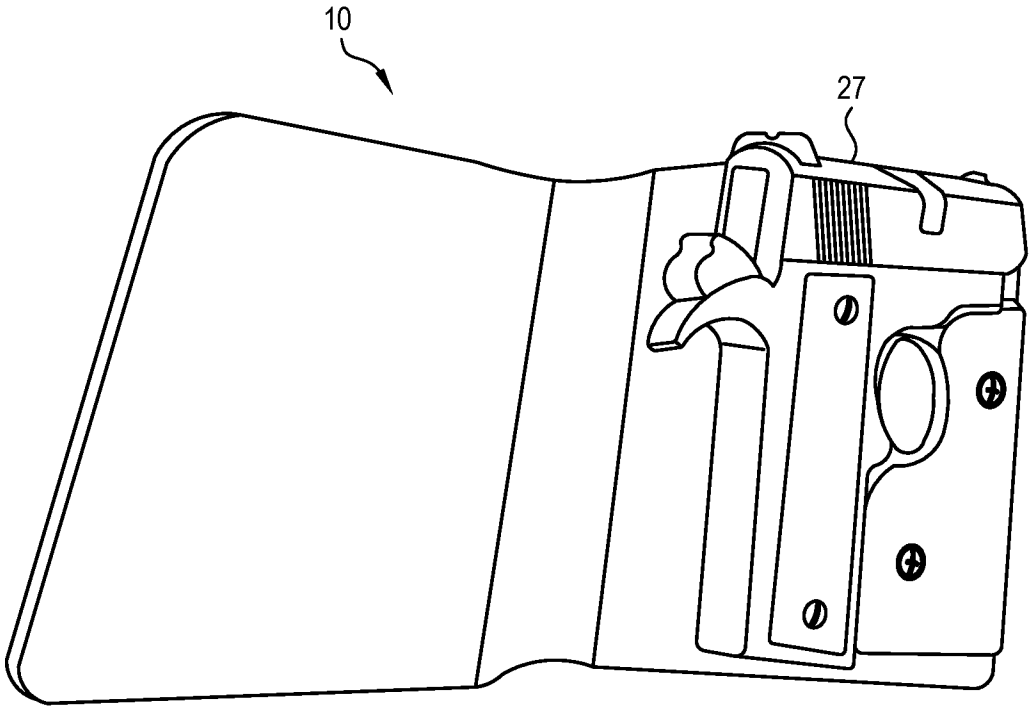
FIG. 3 schematically shows a side perspective inside view of an example embodiment of a wallet style holster with a handgun mounted in the holster retaining element assembled in accordance with the present disclosure.

Referring now to FIG. 3, a side perspective inside view of an example embodiment of a wallet style holster with a handgun mounted in the holster retaining element assembled in accordance with a preferred method of deploying the handgun 27 is schematically shown. Here it can be seen that, when pulled from a user's pocket the wallet holster 10 may easily be opened and the retaining element is configured so that the handgun 27 is easily and quickly removed in a position to fit quickly into a user's hand.

Figure 4:
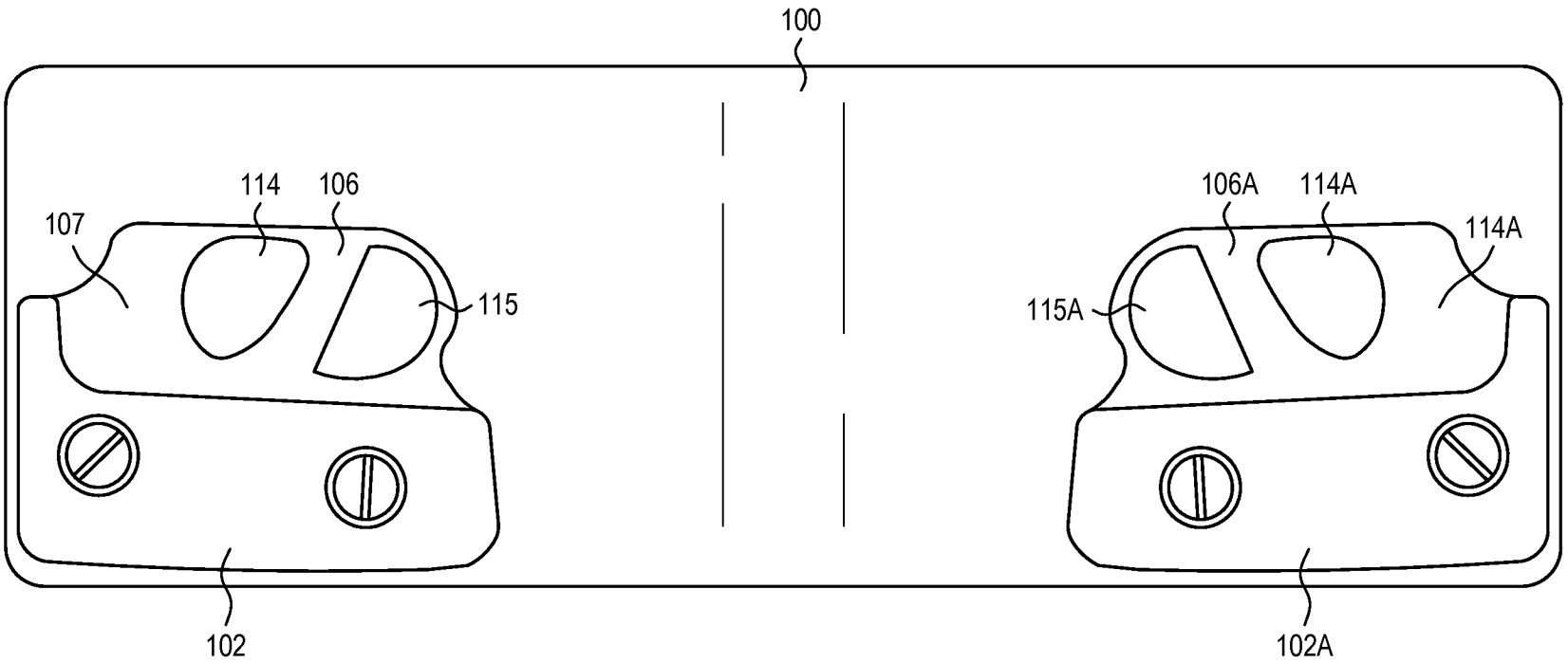
FIG. 4 schematically shows an inside view of an alternate example embodiment of a wallet style holster featuring a pair of clamshell retaining elements assembled in accordance with the present disclosure.

Referring now to FIG. 4, an inside view of an alternate example embodiment of a wallet style holster featuring a pair of clamshell retaining elements is schematically shown. Here an alternate embodiment of a wallet style holster 100 includes a pair of mating retaining blocks 102, 102A where the mating retaining blocks are configured to close over and retain a handgun with a trigger that rests in a mating pair of trigger channels 106, 106A. The wallet 100 is constructed and used substantially as described above. However, wallet style holster 100 can be used ambidextrously. The trigger channels 106, 106A separate two generally oblong protrusions 114, 114A, 115, 115A and a cavity 107, 107A configured to conform to and hold the trigger portion of a handgun of similar shape and size.

Those skilled in the art having the benefit of this disclosure will appreciate that, as with the standard models of holster, a wallet holster, as described herein in various aspects, will preferably be tailored to fit a specific handgun. One useful advantage of the clamshell design described above is that it features an ambidextrous style design that equally accommodates a right-handed or left-handed user. Also the presence of the central "trigger channel" is shown in this example because the pistol it is made for has a trigger located in the center of the trigger guard. However, the invention is not so limited and a clamshell version can be made to accommodate handguns that can be holstered without the need for the central trigger channel.

Figure 5:
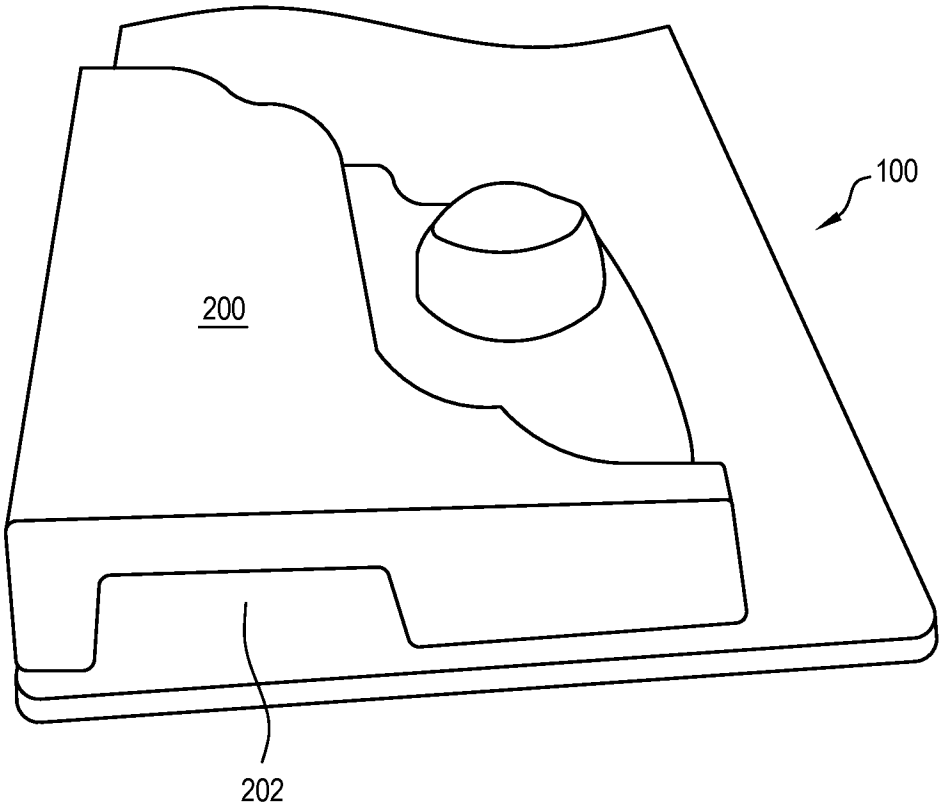
FIG. 5 schematically shows a side view of an alternate example embodiment of a wallet style holster featuring a retaining element constructed with a magazine storage port which is assembled in accordance with the present disclosure.
Figure 6:
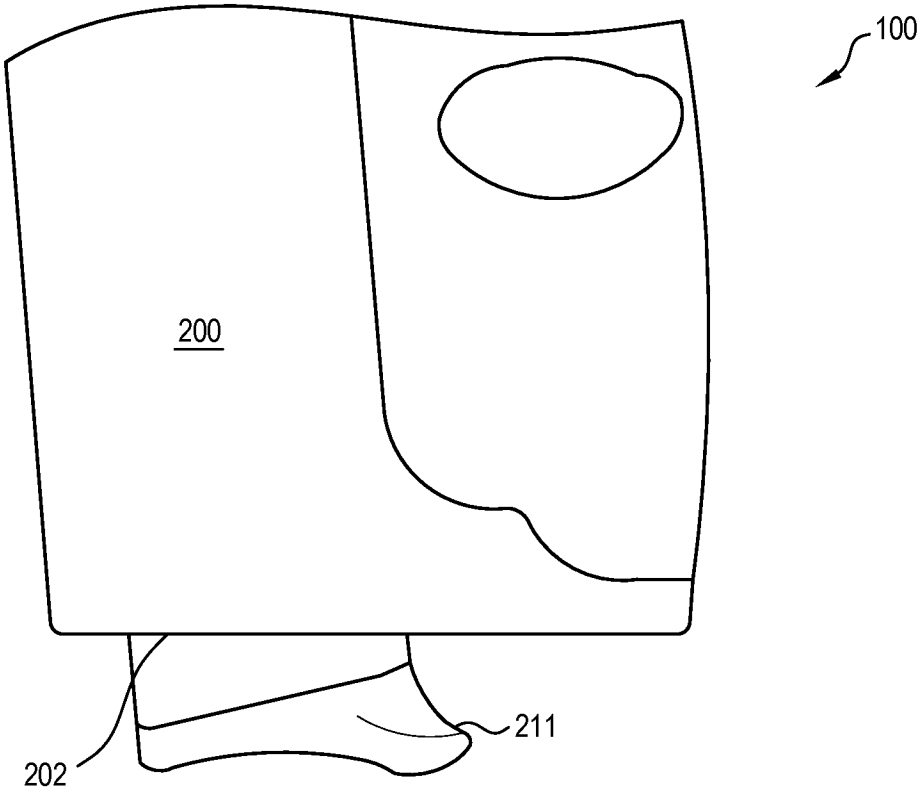
FIG. 6 schematically shows a side view of an alternate example embodiment of a wallet style holster featuring a retaining element constructed with a magazine storage port shown holding a spare magazine which is assembled in accordance with the present disclosure.

Referring now to FIG. 5, a side view of an alternate example embodiment of a wallet style holster featuring a retaining element constructed with a magazine storage port is schematically shown. Here an alternate embodiment of a wallet style holster 100 includes a slightly modified retaining block 200, configured to retain a handgun similarly to that described in FIG. 1. The modified retaining block 200 differs in the respect that it includes a magazine storage port 202 shaped to accept a handgun magazine. The magazine storage port may be a rectangular shape sized to snugly hold a handgun magazine. FIG. 6 illustrates a magazine 211 inserted into the magazine storage port 202.

Figure 7:
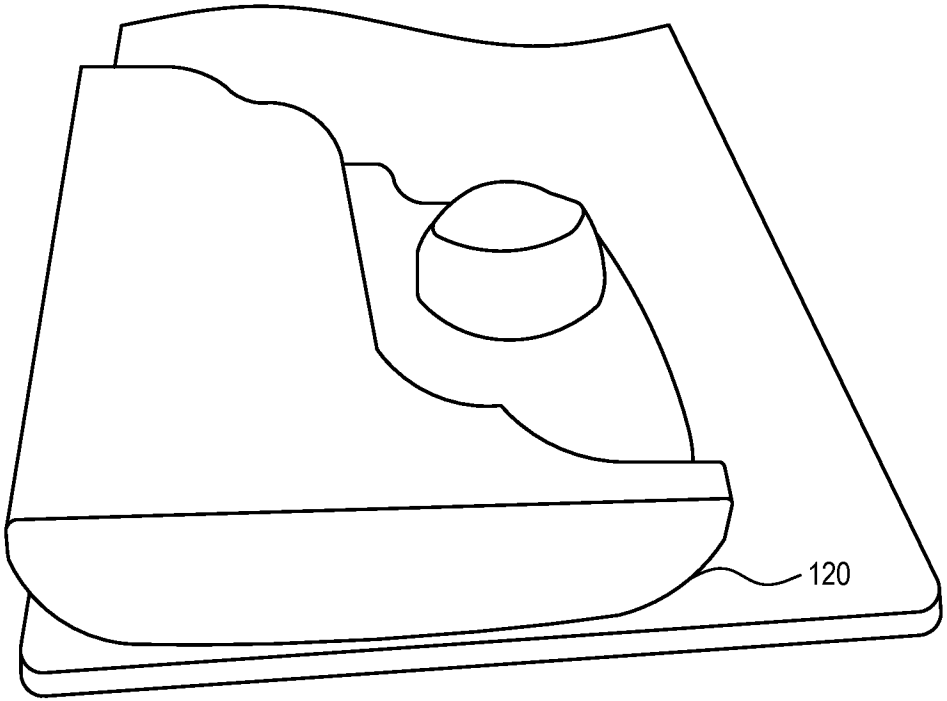
FIG. 7 schematically shows a side view of an example embodiment of a wallet style holster featuring rounded edges on the retaining element which is assembled in accordance with the present disclosure.

Referring now to FIG. 7, a side view of an example embodiment of a wallet style holster featuring rounded edges on the retaining element which is assembled in accordance with the present disclosure is schematically shown. In some embodiments it has been found to be advantageous to round the edges of the handgun retaining element 14. Here shown is an example of rounded edges 120. This allows for easier placement and removal of the folded wallet in or from a pocket. The rounded edges also help reduce the profile of the outline of the holster as it appears in a back pocket, making the wallet holster more closely resemble a standard billfold style wallet, thereby aiding in concealment.

Figure 8:
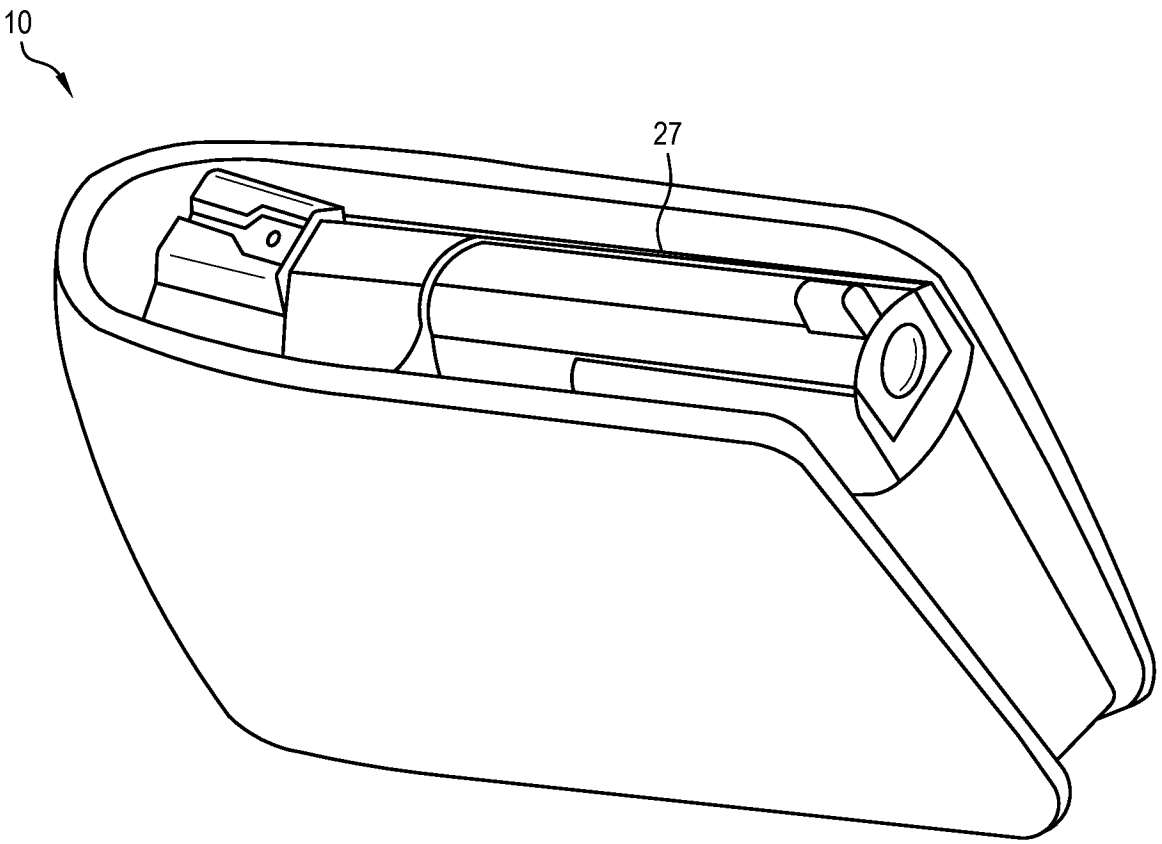
FIG. 8 schematically shows a perspective view of an example embodiment of a wallet style holster in a folded mode.

Referring now to FIG. 8 a perspective view of an example embodiment of a wallet style holster in a folded mode is schematically shown. A wallet style holster 10 is folded to conceal a handgun 27 when inserted into a pocket.

Having fully described the construction of the invention, it is considered helpful to the understanding of the invention to now describe the operation of the wallet style handgun holster. Again referring jointly to FIG. 2 and FIG. 3, to use the holster for carrying a pistol, the pistol is placed inside the holster 12. The handgun retaining element 14 holds the pistol positioned inside. The leather covering is then closed, and the holster placed in the back pocket like a normal wallet. With the holster inside the back pocket, the pocket holds the outer flap closed, and the outer flap secures the pistol inside the holster. To draw the pistol for use, the wallet holster is removed from the pocket using the non-shooting hand, the leather covering opened, and the gun flipped into the opposite hand as inferred in FIG. 3.

In summary, the present invention addresses drawbacks in the prior art by providing examples of a foldable wallet style holster that fully covers a handgun when inserted into a pocket by utilizing a simple folded leather outer covering, similar in appearance and function to a billfold wallet, combined with a molded insert of plastic or other suitable solid material that is attached to the inside of the leather covering with rivets, screw post bolts or equivalents. The plastic insert is molded to fit into the empty space between the barrel and grip of the pistol, and also inside the trigger guard. Properly molded and shaped, this insert securely holds the pistol in place when the leather covering is closed. The insert is made to the approximate thickness of the pistol in order to give the entire wallet holster a uniform thickness and prevent "printing" of the gun's shape upon the exterior of the pocket. When the wallet is removed from the pocket and the covering is opened, the pistol is no longer secured and can be quickly flipped or dropped into the user's other hand, without need for additional steps to withdraw it. While this method might not be quite as fast as drawing the gun directly from the holster while in the pocket, or drawing a pistol and holster made to function as one unit, the primary concern being addressed with this holster is that the gun not be noticed by someone seeing into the pocket. The molded plastic insert can be made to accommodate firearm accessories and attachments such as lasers or lights. For some pistols, the plastic insert could also be made to hold a spare pistol magazine.

The invention has been described herein in considerable detail in order to comply with the Patent Statutes and to provide those skilled in the art with the information needed to apply the novel principles of the present invention, and to construct and use such exemplary and specialized components as are required. However, it is to be understood that the invention may be carried out by different equipment, and devices, and that various modifications, both as to the equipment details and operating procedures, may be accomplished without departing from the true spirit and scope of the present invention.

What is claimed is:

1. A wallet style holster for holding and concealing a handgun comprising:

a wallet-shaped rectangular foldable panel including a top flap portion and a bottom flap portion;

a single-piece handgun retaining block attached to the bottom flap portion;

where the handgun retaining block includes a trigger guard retention region and a forward block;

at least one protrusion is separated from the forward block by a channel, where the channel and the protrusion are formed to receive a handgun trigger and trigger guard which is held between the protrusion and the forward block;

where the top flap portion of the elongated panel may be folded over the bottom flap portion to form a wallet, sized so as to cover the sides and butt end of a handgun, and fit into a pocket to conceal the handgun;

wherein the handgun retaining block consists of a single-piece solid molded insert that is attached to the inside of the rectangular foldable panel and is molded to fit into only the empty space below the barrel and forward of the grip of a handgun and inside the trigger guard so as to hold the handgun in place when the rectangular foldable panel covering is closed and so as to release the handgun when the rectangular foldable panel covering is opened and flipped and the holster is tilted to flip the handgun into the shooting hand; and wherein the retaining block is made to the approximate thickness of the handgun in order to give the entire wallet holster a generally uniform thickness and prevent printing of the handgun's shape upon the exterior of the pocket.

2. The wallet style holster of claim 1 wherein the handgun retaining block removably mates with the handgun.

3. The wallet style handgun holster of claim 1 wherein the elongated panel comprises a single piece of leather having a thickness suitable for folding over a conventionally sized handgun while still fitting in the back pocket of a pair of pants, so as to conceal the butt end of any enclosed handgun.

4. The wallet style handgun holster of claim 3 wherein the elongated panel has a length in the range of 10-13 inches and a width in the range of 3-5 inches.

5. The wallet style handgun holster of claim 1 wherein retaining element comprises a molded insert constructed from materials selected from the group consisting of nylon, plastic, polymer compositions, metal, rubber and combinations thereof.

6. A wallet style holster for holding and concealing a handgun comprising:

a wallet-shaped rectangular foldable panel including a top flap portion and a bottom flap portion;

a pair of mating retaining blocks, a first block attached to the top flap portion and a second block attached to the bottom flap portion;

each of the pair of mating retaining blocks having matching channels to accommodate a trigger guard, and optionally including matching channels to accommodate a trigger, and each of the mating blocks including a cavity configured to accept and hold a handgun portion;

where the top flap portion of the elongated panel may be folded over the bottom flap portion to form a wallet, sized so as to be adapted to cover a handgun butt end and fit into a pocket so as to conceal any enclosed handgun; and wherein the pair of mating retaining blocks consist of mating solid molded inserts that are attached to the inside of the rectangular foldable panel and molded to fit into only the empty space between the barrel and grip of a handgun and inside the trigger guard so as to hold the handgun in place when the rectangular foldable panel covering is closed and so as to release the handgun when the rectangular foldable panel covering is opened and the gun flipped out and into a shooting hand; and wherein the pair of mating retaining blocks are made to approximate the thickness of the handgun in order to give the entire wallet holster a uniform thickness and prevent printing of the handgun's shape upon the exterior of the pocket.

7. The wallet style holster of claim 6 wherein the pair of mating retaining blocks removably mates with the handgun.

8. The wallet style handgun holster of claim 6 wherein the pair of mating retaining blocks are affixed to opposing ends of the elongated panel with materials selected from the group consisting of rivets, bolts metal screws, plastic screws, glue, epoxy, and combinations thereof.

9. The wallet style handgun holster of claim 6 wherein the elongated panel comprises a single piece of leather having a thickness suitable for folding over a conventionally sized handgun while still fitting in the back pocket of a pair of pants.

10. The wallet style handgun holster of claim 1 wherein the elongated panel has a length in the range of 10-13 inches and a width in the range of 3-5 inches.

11. The wallet style handgun holster of claim 6 wherein retaining element comprises a molded insert constructed from materials selected from the group consisting of nylon, plastic, polymer compositions, metal, rubber and combinations thereof.

12. A wallet style holster for holding and concealing a handgun having a barrel, grip and trigger guard, the holster comprising:

a foldable leather covering combined with a molded insert that is attached to the inside of the foldable leather covering;

where the molded insert has channels and protrusions sized and located to receive an inserted handgun so as to securely hold the handgun in place when the leather covering is closed, and where the molded insert has a thickness substantially the same as the thickness of the handgun;

wherein the molded insert consists of a single-piece solid molded insert that is molded to fit into only the empty space below the barrel and forward of the grip of a handgun and inside the trigger guard so as to hold the handgun in place when the rectangular foldable panel covering is closed and so as to release the handgun when the rectangular foldable panel covering is opened and flipped and the holster is tilted to flip the handgun into the shooting hand; and where the foldable leather covering covers the handgun butt end when folded and inserted into a pocket.

13. The wallet style handgun holster of claim 12 wherein the wallet style holster has an opened length in the range of 10-13 inches and a width in the range of 3-5 inches.

14. The wallet style handgun holster of claim 12 wherein molded insert comprises a molded insert constructed from materials selected from the group consisting of nylon, plastic, polymer compositions, metal, rubber and combinations thereof.

* * * * *